US007507896B2

(12) United States Patent
Uehara

(10) Patent No.: US 7,507,896 B2
(45) Date of Patent: Mar. 24, 2009

(54) SIMPLE MUSIC PERFORMANCE SYSTEM, MUSIC DATA SUPPLIER AND COMPUTER PROGRAM INSTALLED IN THE MUSIC DATA SUPPLIER

(75) Inventor: Haruki Uehara, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 266 days.

(21) Appl. No.: 11/489,877

(22) Filed: Jul. 20, 2006

(65) Prior Publication Data

US 2007/0017350 A1 Jan. 25, 2007

(30) Foreign Application Priority Data

Jul. 20, 2005 (JP) ..... 2005-209823

(51) Int. Cl.
*G10H 1/00* (2006.01)

(52) U.S. Cl. ..... 84/601; 84/600

(58) Field of Classification Search ..... 84/600–602
See application file for complete search history.

(56) References Cited

U.S. PATENT DOCUMENTS

| | | | | |
|---|---|---|---|---|
| 5,247,129 | A | 9/1993 | Nozaki et al. | |
| 6,803,511 | B2 * | 10/2004 | Mizuno | 84/600 |
| 6,949,704 | B2 * | 9/2005 | Funaki | 84/609 |
| 7,283,881 | B2 * | 10/2007 | Puryear | 700/94 |
| 7,293,060 | B2 * | 11/2007 | Komsi | 709/203 |
| 7,294,776 | B2 * | 11/2007 | Tohgi et al. | 84/600 |
| 2001/0056375 | A1 * | 12/2001 | Kunii | 705/14 |
| 2002/0056117 | A1 | 5/2002 | Hasegawa et al. | |
| 2003/0136247 | A1 * | 7/2003 | Mizuno | 84/600 |
| 2003/0177889 | A1 | 9/2003 | Koseki et al. | |
| 2003/0196542 | A1 | 10/2003 | Harrison | |
| 2005/0155484 | A1 * | 7/2005 | Yanase et al. | 84/615 |
| 2005/0235809 | A1 * | 10/2005 | Kageyama | 84/601 |

FOREIGN PATENT DOCUMENTS

| | | |
|---|---|---|
| EP | 1383107 | 1/2004 |
| GB | 2408128 | 5/2005 |
| JP | 5-80750 | 4/1993 |
| WO | WO-01-16931 | 3/2001 |

* cited by examiner

*Primary Examiner*—David S. Warren
(74) *Attorney, Agent, or Firm*—Harness, Dickey & Pierce, PLC

(57) ABSTRACT

At least one musical instrument, a server computer, a mobile telephone and a communication network form a music performance system; the owner has registered the musical instrument with a client database in the server computer, and a user transmits a request for music data distribution service to the server computer through the mobile telephone; upon reception of the request, the server computer searches the client database to see whether or not the owner has contracted the provider for the music data distribution service; when the server computer finds the owner in the client database, the server computer transmits a set of music data codes directly to the musical instrument so that the mobile telephone is shareable between the musical instrument and another musical instrument.

21 Claims, 8 Drawing Sheets

5

| IDENTIFICATION CODE | IP ADDRESS |
|---|---|
| PianoID01 | 210. 145. 108. 18 |
| PianoID02 | 192. 168. 0. 202 |
| ⋮ | ⋮ |

Fig. 3 A

7

| IDENTIFICATION CODE | MUSIC TUNES |
|---|---|
| PianoID01 | Song012 |
| PianoID01 | Song209 |
| ⋮ | ⋮ |
| PianoID01 | Song503 |
| PianoID02 | Song010 |
| PianoID02 | Song013 |
| ⋮ | ⋮ |
| PianoID03 | Song055 |
| PianoID04 | Song014 |
| ⋮ | ⋮ |

Fig. 3 B

SIMPLE MUSIC PERFORMANCE SYSTEM, MUSIC DATA SUPPLIER AND COMPUTER PROGRAM INSTALLED IN THE MUSIC DATA SUPPLIER

FIELD OF THE INVENTION

This invention relates to a music performance system and, more particularly, to a music performance system for performing pieces of music, a music database server forming a client-server model together with musical instruments and a computer program installed in the music database server.

DESCRIPTION OF THE RELATED ART

Musical instruments are categorized in the acoustic musical instrument, electric musical instrument and hybrid musical instrument. An automatic player piano is a typical example of the hybrid musical instrument. The automatic player piano is a combination of an acoustic piano and an electric system installed inside of the acoustic piano. Solenoid-operated key actuators and a controller form the electric system. The solenoid-operated key actuators are provided under the black keys and white keys of the acoustic piano, and the controller is connected to the solenoid-operated key actuators through a distribution cable.

When a user wishes to reproduce a piece of music through the automatic player piano, the user instructs the controller selectively to drive the solenoid-operated key actuators. A set of music data codes, which expresses the piece of music, is loaded into the controller, and the controller starts sequentially to process the music data codes. When the time to produce a tone comes, the controller supplies electric power to the solenoid-operated key actuator through the distribution cable. The electric power is converted to force through the solenoid-operated key actuator, and the force is exerted on the black/white key. The black/white key is driven to actuate the associated action unit, which in tern drives the association hammer for rotation toward the associated string. The hammer is brought into collision with the string so as to give rise to vibrations of the string. The tone is radiated from the vibrating string.

The controller selectively drives the solenoid-operated key actuators for the playback so that the above-described action is repeated for all the tones in the piece of music. As a result, the piece of music is reproduced without any fingering of a human player.

Conventionally, the set of music data codes is stored in a portable information storage medium such as a compact disk or a flexible disk. The user inserts the compact disk or flexible disk into a slot of the controller, and instructs the controller to read the set of music data codes there into. However, the compact disks and flexible disks are sold in music shops. When a user wishes to reproduce a new piece of music, the user has to buy the compact disk or flexible disk, in which the new piece of music has been already recorded, at the music shop. To go shopping is time-consuming, and most of the moderns are busy. In other words, the moderns wish immediately to obtain the set of music data codes, which expresses the new piece of music.

The computer communication network such as, the Internet, makes it possible immediately to download the set of music data codes expressing the new piece of music. In the prior art music performance system, hybrid musical instruments form a client-server model together with a music database server computer. When a user wishes to reproduce a new piece of music through the hybrid musical instrument, the user downloads a set of music data codes expressing the new piece of music from the music database server to the automatic player piano through the computer communication network, and instructs the hybrid musical instrument to reproduce the new piece of music on the basis of the set of music data codes.

In order to communicate with the music database server computer, a special-purpose communication terminal device is required for the automatic player piano. The user requests the music database server to supply the set of music data codes through the special-purpose communication terminal device. The music database server supplies the set of music data codes to the special-purpose communication terminal device through the computer communication network, and the set of music data codes are transferred from the special-purpose terminal device to the controller of the automatic player piano. Thus, the user immediately obtains the set of music data codes through the computer communication network for the playback.

However, the special-purpose communication terminal device is expensive. The user has to bear not only a large amount of initial cost but also running cost for the special-purpose communication terminal device. This is one of the reasons why the automatic player piano has not won popularity.

Portable telephones are now popular in the world, and it has been proposed to communicate with a music database server by means of a portable telephone. The prior art client-server model is disclosed in Japanese Patent Application laid-open No. 2002-341864.

In the Japanese Patent Application laid-open, the portable telephone is connected to an electronic musical instrument, and user requests the music database server computer to download a set of music data codes to the electronic musical instrument by means of the portable telephone. Thus, the portable telephone is used as the communication interface in the prior art client-server model.

Since the portable telephone is connected to the electronic musical instrument as the communication interface between the music database server computer and the electronic musical instrument, the portable telephone is required for every electronic musical instrument. A user is assumed to set up plural electric musical instruments and/or plural hybrid musical instrument in a public space such as, for example, an exhibit hall or a hotel lobby. The user has to prepare plural portable telephones, the number of which is equal to the total number of the electric/hybrid musical instruments, for selectively download sets of music data codes from the music database server. In other words, the plural portable telephones makes the prior art music performance system complicated. This is the problem encountered in the prior art music performance system disclosed in the Japanese Patent Application laid-open.

SUMMARY OF THE INVENTION

It is therefore an important object of the present invention to provide a music performance system, which is simple in system configuration.

It is also an important object of the present invention to provide a music data supplier, which forms a part of the music performance system.

It is another important object of the present invention to provide a computer program, which runs on the music data supplier.

To accomplish the object, the present invention proposes to accept a request for music data distribution service from a terminal device independent of musical instruments.

In accordance with one aspect of the present invention, there is provided a music performance system for distributing pieces of music data expressing music tunes to users, and the music performance system comprises plural musical instruments identifiable with pieces of client data, respectively, and responsive to pieces of music data for performing music tunes, a client database storing the pieces of client data for establishing communication channels to the plural musical instruments, a music database storing the pieces of music data respectively expressing the music tunes, a music data distributor accessible to the client database and the music database, responsive to a request for music data distribution service so as to search the client database to see whether or not a certain piece of client data is found in the client database and supplying at least one of the pieces of music data to one of the plural musical instruments assigned the certain piece of client data when the certain piece of client data is found in the client database, a terminal device transmitting the request for music data distribution service, the certain piece of client data and a piece of tag data expressing the aforesaid at least one of the pieces of music data to the music data distributor and a communication network to which the plural musical instruments, the music data distributor and the terminal device are connectable so that the aforesaid at least one of the pieces of music data, the request for music data distribution service, the certain piece of client data and the piece of tag data are propagated through the communication channels in the communication network among the aforesaid one of the plural musical instruments, the music data distributor and the terminal device.

In accordance with another aspect of the present invention, there is provided a music data supplier for distributing pieces of music data to plural musical instruments through a communication network comprising a client database storing pieces of client data respectively assigned to the plural musical instruments and expressing destinations of the pieces of music data, a music database storing the pieces of music data respectively expressing music tunes, and a music data distributor accessible to the client database and the music database, responsive to a request for music data distribution service accompanied with a certain piece of client data and a piece of tag data expressing one of the music tunes and transmitted from a terminal device independent of the plural musical instruments through the communication network so as to check the client database to see whether or not the certain piece of client data is found therein and supplying one of the pieces of music data expressing the certain music tune through the communication network to the aforesaid one of the plural musical instruments when the certain piece of client data is found in the client database.

In accordance yet another aspect of the present invention, there is provided a computer program running on a music data supplier and expressing a method comprising the steps of a) preparing a client database storing pieces of client data respectively assigned to plural musical instruments and expressing destinations of pieces of music data and a music database storing the pieces of music data respectively expressing music tunes, b) receiving a request for music data distribution service and a certain piece of client data from a terminal device independent of the plural musical instruments, c) checking the client database to see whether or not the certain piece of client data indicative of a certain musical instrument is found as one of the pieces of client data, and d) transmitting one of the pieces of music data expressing a certain music tune requested through the terminal device from the music database to one of the plural musical instruments assigned the certain piece of client data when the answer at step c) is given affirmative.

BRIEF DESCRIPTION OF THE DRAWINGS

The features and advantages of the music performance system, music database server and computer program will be more clearly understood from the following description taken in conjunction with the accompanying drawings, in which FIG. 3A is a view showing the structure of a client database, FIG. 3B is a view showing the structure of a music database.

DESCRIPTION OF THE PREFERRED EMBODIMENTS

Figure 1:
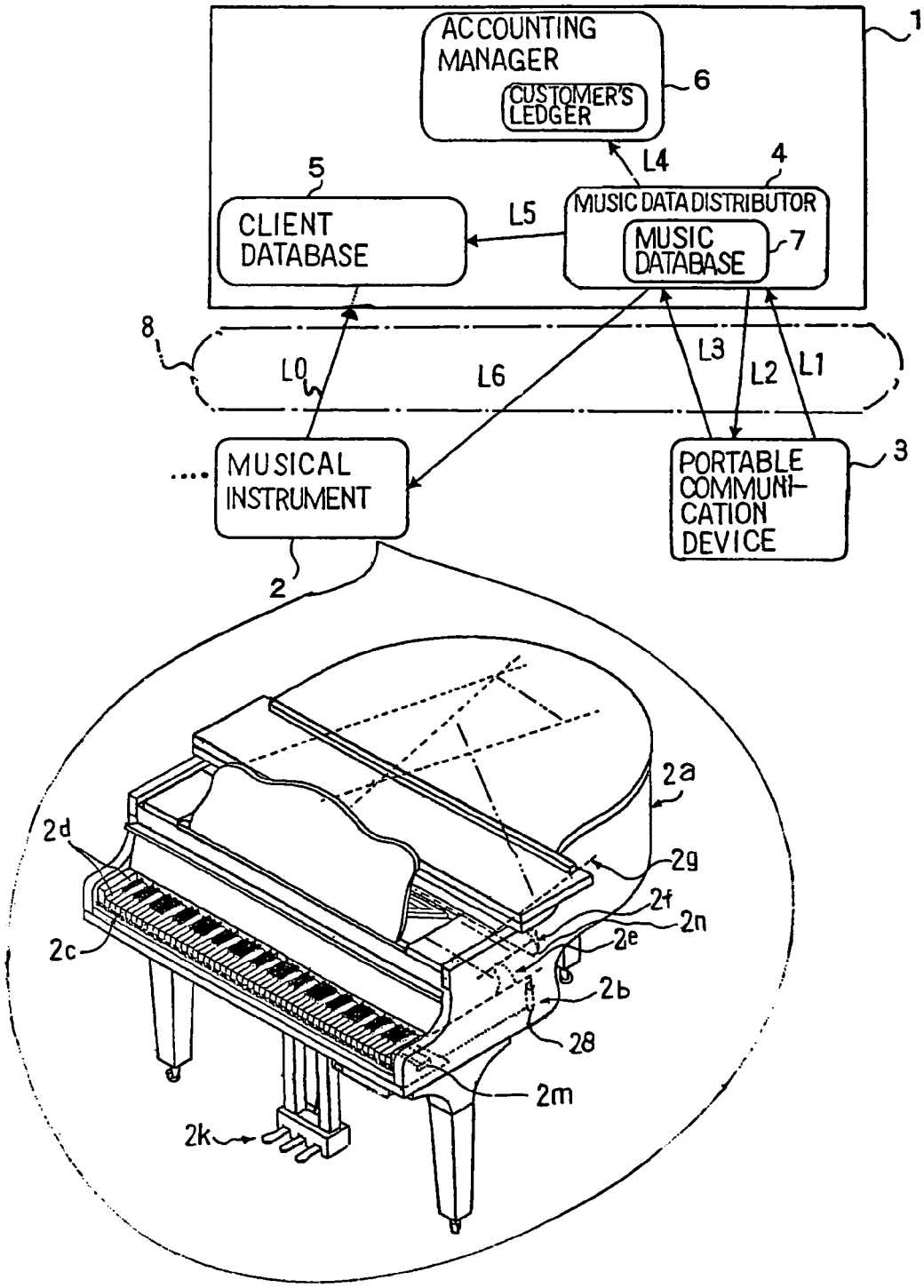
FIG. 1 is a schematic view showing a music performance system according to the present invention.

A music performance system embodying the present invention comprises plural musical instruments, a client database, a music database, a music data distributor, a terminal device and a communication network. The plural musical instruments, music data distributor and terminal device are connectable to the communication network so that pieces of music data, a request for music data distribution service, pieces of client data, pieces of tag data are transmittable there among through the communication network.

The music data distributor is connected to the client database and music database so as to access the pieces of client data, which are stored in the client database, and the pieces of music data, which are stored in the music database. In this instance, the music data distributor is connected through cables to the client database and music database. In case where addresses are respectively assigned to the client database and music database, the pieces of client data, pieces of tag data and pieces of music data may be propagated through the communication network.

The pieces of client data are respectively assigned to the plural musical instruments so that each of the plural musical instruments is identifiable with the piece of client data already assigned thereto. Each of the plural musical instruments is responsive to a piece of music data so as to produce a music tune, which is expressed by the piece of music data.

A user manipulates the terminal device. When the user wishes to download a piece of music data expressing a certain music tune to one of the musical instruments, the user establishes a communication channel between the terminal device and the music data distributor in the communication network. The user manipulates the terminal device so as to prepare a piece of client data expressing the musical instrument and a piece of tag data expressing the certain music tune, and transmits the piece of client data, piece of tag data and a request for music data distribution service to the music data distributor through the communication channel.

The music data distributor searches the client database to see whether or not the piece of client data, which is transmitted from the terminal device, is found in the client database. If the piece of client data is not found, the music data distributor does not supply the piece of music data to the musical instrument, because the owner of the musical instrument has not been under the contract with the music data provider. When the music data distributor finds the piece of client data in the client database, the music data distributor establishes a communication channel to the musical instrument assigned the piece of client data in the communication network. Upon establishment of the communication channel, the music data distributor starts to supply the piece of music data to the musical instrument. The musical instrument starts to reproduce the music tune on the basis of the piece of music data.

As will be appreciated from the foregoing description, the user directly downloads the piece of music data to the target musical instrument, and the terminal device does not form any part of the path for the downloading. For this reason, while the music tune is being reproduced on the musical instrument, it is possible for the user to transmit another request for music data distribution service to the music data distributor. If another musical instrument has already registered with the client database, another piece of music data is downloaded from the music data distributor to the other musical instrument. Thus, the terminal device is shareable among the plural musical instruments. This results in the simple system configuration of the music performance system of the present invention.

First Embodiment

Referring to FIG. 1 of the drawings, a music performance system embodying the present invention largely comprises a server computer 1, at least one music instrument 2, a portable communication device 3 and a communication network 8. A lot of pieces of music data, which express pieces of music or music tunes, are stored in a music database 7 in the server computer 1, and pieces of identification data and addresses assigned thereto are registered with a client database 5. The piece of identification data, address and other pieces of information, which are useful for management of music distribution services, are referred to as a "piece of client information" assigned to the musical instrument 2. The musical instrument 2 and portable communication device 3 have data processing capability and communication capability through the communication network 8.

The server computer 1 and musical instrument 2 are connected to the communication network 8, and are communicable with each other through the communication network 8. A user usually brings the portable communication device 3 anywhere he goes, and the portable communication device 3 is connectable to the communication network 8. When the user wishes to communicate with the server computer 1, the user connects the portable communication device 3 to the communication network 8, and transmits messages to and receives the response from the server computer 1 through the communication network 8. Thus, the server computer 1, musical instrument 2 and portable communication device 3 form a client-server model.

A user is assumed to wish to reproduce a piece of music through the musical instrument 2. The user has already registered the musical instrument 2 with the server computer 1. In other words, a piece of identification data expressing the musical instrument 2 has been already stored in the client database 5 together with an address assigned to the musical instrument 2. The user connects the portable communication device 3 to the server computer 1 through the communication network 8, and transmits the piece of identification data indicative of the musical instrument, a request for downloading and a piece of music data expressing the piece of music data to the server computer 1. The service, i.e., the request for downloading and piece of music data may be specified with the assistance of a suitable browser.

The server computer 1 checks the client database 5 to see whether or not the musical instrument 2 is found as a client. If the answer is given positive, the address is read out from the client database 5, and the piece of music data is taken out from the music database 7. The server computer 1 establishes a data transmission channel to the musical instrument in the communication network 8, and transmits the piece of music data to the musical instrument 2.

Even though a lot of musical instruments have been already registered with the server computer 1, the server computer 1 discriminates the musical instrument 2 from the other musical instruments by virtue of the piece of identification data. For this reason, the user can request the downloading to the server computer 1 through the portable communication device 3 without, any direct communication channel between the musical instrument 2 and the portable communication device 3. If a user wishes to download a piece of music data to another musical instrument, the user inputs a piece of identification data, which is indicative of the other musical instrument, into the portable communication device 3, and requests the server computer 1 to transmit the piece of music data to the other musical instrument through the communication network 8. Thus, the portable communication device 3 is shareable among the musical instruments. As a result, the music performance system is simpler than the prior art music performance system disclosed in the Japanese Patent Application laid-open.

The system components, i.e., the server computer 1, musical instrument 2, portable communication device 3 and communication network 8 are hereinafter described in more detail.

Server Computer

The server computer 1 includes a music data distributor 4 and an accounting manager 6, and manages a web site. Although the server computer 1 achieves other tasks such as, for example, the registration of clients, these functions are not shown in FIG. 1. The music data distributor 4 and accounting manager 6 express functions of the server computer 1 so that a computer program, which runs on the server computer 1, realizes the functions. The music data distributor 4 is linked with the client database 5 and accounting manager 6 in order to offer music data distribution services to users for pay.

The pieces of client information are stored in the client database 5, and a lot of sets of music data codes, which express music tunes, are stored in the music database 7 together with explanatory data codes. As described hereinbefore, each piece of client information includes a piece of identification data, an address and so forth. When a user requests the server computer 1 to register a new musical instrument 2, the server computer 1 accepts a piece of client information as indicated by arrow L0, and registers the new musical instrument 2 with the client database 5. The browser assists the user in the registration work. The sets of music data codes are accompanied with the explanatory codes expressing music titles, music categories and so forth. Thus, the piece of music information is indicative of a set of music data codes, associated explanatory data codes and other data codes used in the management of the music database 7.

The music distributor 4 manages the music database 7, and responds to user's request. When a user wishes to download a set of music data codes expressing a music tune, the user establishes the communication channel in the communication network 8 as indicated by arrow L1. Then, the music data distributor 4 activates the browser so as to assist the user in selecting the music tune, and transmits prompt messages and images of icons to the portable communication device 3 as indicated by arrow L2. The user manipulates the portable communication device 3, and selects the music tune to be downloaded with the assistance of the browser. Upon completion of selecting work, the user transmits a request for the download and the piece of identification data expressing the musical instrument 2 to the music data distributor 4 through the communication network 8 as indicated by arrow L3.

Then, the music data distributor 4 checks the client database 5 to see whether or not the musical instrument 2 has already registered with the client database 5 as indicated by arrow L5. If the answer is given negative, the music data distributor 4 transmits a negative message to the portable communication device 3. When the music data distributor 4 finds the piece of identification data in the client database 5, the music data distributor 4 reads out the set of music data codes from the music database 7, and transmits the set of music data codes to the musical instrument 2 through the communication network 8 as indicated by arrow L6. The music data distributor 4 may inform the user of the completion of download by means of the portable communication device 3.

Upon completion of the download, the music data distributor 4 informs the accounting manager 6 of the downloading work as indicated by arrow L4. Then, the accounting manager 6 books the charge in a customer's ledger. The charge for the download is sent to the owner of the portable communication device 3.

Although the accounting manager 6 is realized in the server computer 1 in this instance, the accounting manager is separated from the music data distributor 4 in a modification. Thus, the accounting manager 6 is not an indispensable system component of the music performance system of the present invention.

Figure 2:
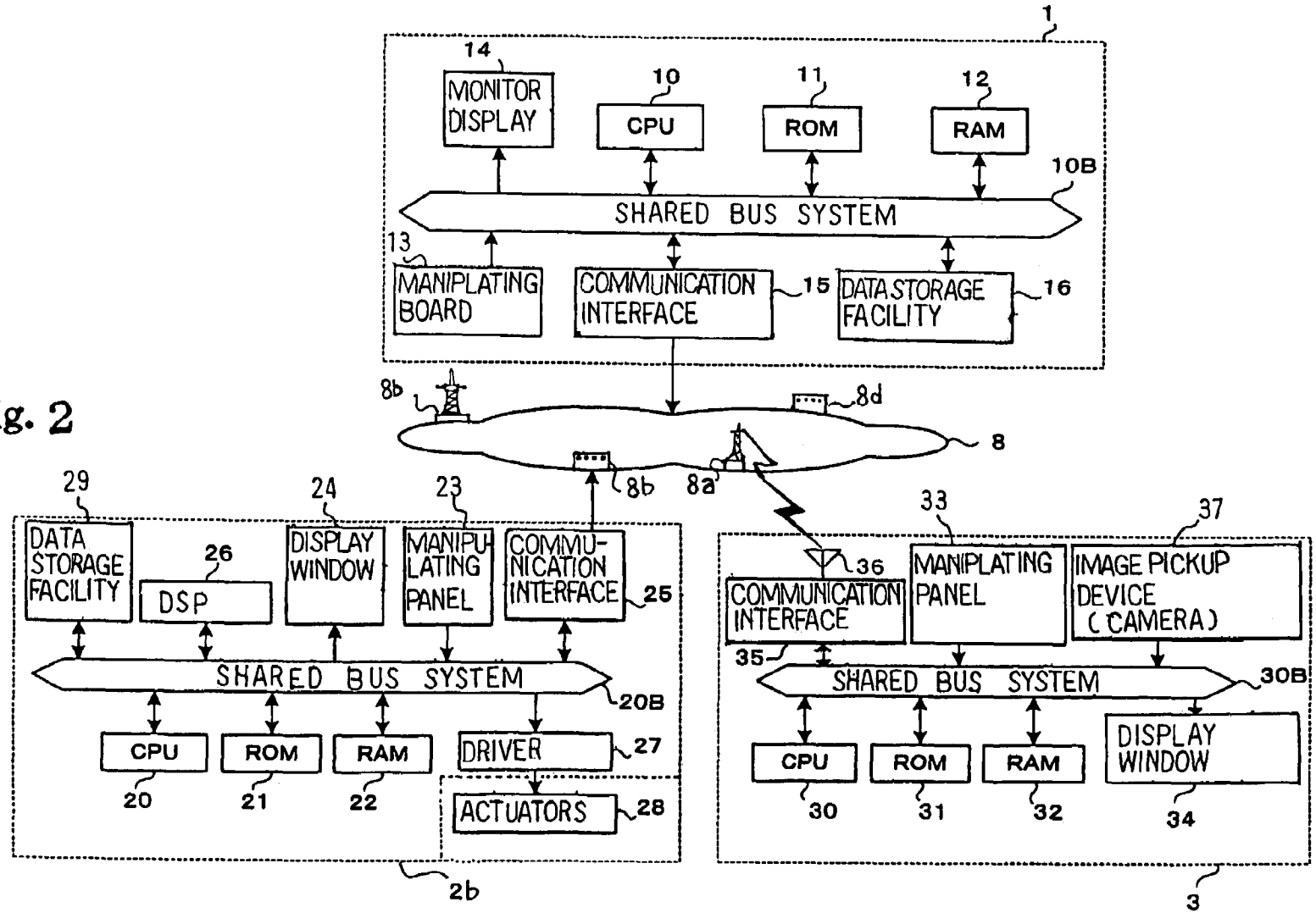
FIG. 2 is a block diagram showing electronic systems incorporated in the music performance system.

Turning to FIG. 2 of the drawings, the server computer 1 includes a central processing unit 10, which is abbreviated as "CPU", a read only memory 11, which is abbreviated as "ROM", a random access memory 12, which is abbreviated as "RAM", a manipulating board 13, a monitor display 14, a communication interface 15, a data storage facility 16 and a shared bus system 10B. In this instance, the central processing unit 10 is implemented by a monolithic microprocessor. The central processing unit 10, read only memory 11, random access memory 12, manipulating board 13, monitor display 14, communication interface 15 and data storage facility 16 are connected to the shared bus system 10B so that the central processing unit 10 communicates with the other system components 11, 12, 13, 14, 15 and 16 through the shared bus system 10B.

Instruction codes, which form a computer program, are stored in the read only memory 11 and the data storage facility together with other pieces of control data, and the computer program is partially occupies in the random access memory 12 during data processing. The random access memory 12 offers a working area to the central processing unit 10 during the data processing.

The central processing unit 10 is a principal origin of data processing capability of the server computer 1, and the computer program runs on the central processing unit 10. The computer program is broken down into plural routines, and the plural routines selectively run on the central processing unit 10 so as to accomplish given tasks. For example, the central processing unit 10 produces visual images on the monitor display 14, and an operator communicates with the central processing unit 10 through the manipulating board 13. The routines, which run on the central processing unit 10 in the music data distribution work, will be hereinlater described in detail.

The communication interface 15 includes a modem, and the model is connected to the communication network 8. The request for the download, identification data code for the registration and set of music data codes are delivered from the computer network 8 to the server computer 1 and vice versa through the communication interface 15.

The data storage facility 16 offers a huge memory space to the central processing unit 10 so that the client database 5, music database 7 and customer's ledger are established in the data storage facility 16. Any sort of memory devices is available for the data storage facility 16.

Musical Instrument

In the following description, term "front" is indicative of a position closer to a human pianist, who gets ready for fingering, than a position modified with term "rear". A line, which is drawn between a front position and a corresponding rear portion, extends in a "fore-and-aft direction", and a "lateral direction" crosses the fore-and-aft direction at right angle. An "up-and-down" direction is normal to a plane defined by the fore-and-aft direction and lateral direction.

Turning back to FIG. 1, the musical instrument 2 is implemented by an automatic player mute piano. For this reason, the automatic player mute piano is also labeled with reference sign "2" in the following description.

The automatic player mute piano 2 largely comprises an acoustic piano 2*a*, an electronic system 2*b* and a hammer stopper 2*n*. The acoustic piano 2*a* is responsive to fingering of a human player for generating acoustic piano tones, and the electronic system 2*b*, which serves as an automatic player, reenacts a performance on the acoustic piano 2*a* without any fingering of human player.

The hammer stopper 2*n* is changed between a free position and a blocking position. While the hammer stopper 2*n* is staying at the free position, the acoustic piano can produce the acoustic piano tones. When the hammer stopper 2*n* enters the blocking position, the hammer stopper 2*n* prohibits the acoustic piano 2*a* from generating the acoustic piano tones, and the electronic system 2*b*, which serves as an electronic tone generator, produces electronic tones instead of the acoustic piano tones.

The acoustic piano 2*a* includes a keyboard 2*c*, in which plural black keys/plural white keys 2*d* are arranged in the lateral direction, action units 2*e*, hammers 2*f*, strings 2*g* and pedals 2*k*. The keyboard 2*c* is mounted on a key bed, which forms the bottom of a piano cabinet, and is exposed to a pianist. The action units 2*e*, hammers 2*f* and strings 2*g* are housed in the piano cabinet. The action units 2*e* are provided over the rear portions of the black and white keys 2*d*, and are linked with the rear portions, respectively. While the front portion of a black/white key 2*d* is being sunk from a rest position toward an end position, the rear portion of the black/white key 2*d* rises, and activates the associated action unit 2*e*. While the black and white keys 2*d* are staying at the rest positions, the hammers 2*f* take rest on jacks of the associated action units 2*e*, and are spaced from the associated strings 2*g*. In this instance, the hammer stopper 2*n* is provided in a space between the hammers 2*f* and the strings 2*g*.

The pedals 2*k* are linked with the keyboard 2*c* and dampers (not shown). One of the pedals 2*k* is called as a damper pedal, another is called was a soft pedal, and yet another is known as a sostenuto pedal. The damper pedal keeps all the dampers (not shown) spaced from the strings 2*g* so as to prolong the acoustic piano tones. The soft pedal makes the keyboard 2*c*, action units 2*e* and hammers 2*f* offset from the associated strings 2*g* so as to lessen the loudness of the acoustic piano tones. The sostenuto pedal makes the dampers (not shown) individually spaced from the associated strings 2*g*. Thus, the functions of pedals 2*k* are similar to those of a standard grand piano.

The hammer stopper 2*n* is found out of trajectories of the hammers 2*f* at the free position. When the jack escapes from the hammer 2*f* on the way of the associated black/white key 2*d* toward the end position, the hammer 2*f* is driven for rotation toward the string 2*g*. The hammer 2*f* is brought into collision with the string 2*g* at the end of rotation, and gives rise to vibrations of the string 2*g*. As a result, the acoustic piano tone is generated through the vibrations of the string 2*g*.

When the hammer stopper 2*n* is changed to the blocking position, the hammer stopper 2*n* is moved into the trajectories of hammers 2*f*, and prohibits the hammers 2*f* from the collision with the strings 2*g*. For this reason, any acoustic piano tone is not generated at the blocking position. Instead, the electronic system 2*b* monitors the key movements with key sensors 2*m*, and produces the electronic tones at the pitch assigned to the depressed keys 2*c*.

Turning to FIG. 2 of the drawings, again, the electronic system 2*b* includes a shared bus system 20B, a central processing unit 20, which is abbreviated as "CPU", a read only memory 21, which is abbreviated as "ROM", a random access memory 22, which is abbreviated as "RAM", a manipulating panel 23, a display window 24, a communication interface 25, a digital signal processor 26, which is abbreviated as "DSP", and a current driver 27. The central processing unit 20 and other system components 21, 22, 23, 24, 25, 26, 27 and 29 are connected to the shared bus system 20B so that address codes, instruction codes, image data codes, control data codes and music data codes are transferred through between the central processing unit 26 and the other system components 21, 22, 23, 24, 25, 26, 27 and 29 through the shared bus system 20B.

The central processing unit 20 is the origin of the data processing capability of the electronic system 2*b*. The central processing unit 20 may be implemented by a microprocessor. Instruction codes, which form a computer program, are stored in the read only memory 21 and data storage facility 29, and are partially occupied in the random access memory 22. The central processing unit sequentially fetches the instruction codes from the read only memory 21 and random access memory 22 so as to permit the computer program runs thereon. The random access memory 22 offers a working area to the central processing unit during the data processing.

The computer program includes several sub-routine programs, and a main routine program selectively branches to the sub-routine programs depending upon given tasks. One of the sub-routine programs runs on the central processing unit 20 for the registration with the client database 5. Another sub-routine program runs on the central processing unit 20 for receiving a set of music data codes downloaded from the server computer 1. Yet another sub-routine program runs on the central processing unit 20 for a playback, and still another sub-routine program runs for recording a performance on the acoustic piano 2*a*.

Keys, switches and control levers are arranged on the manipulating panel 23, and users give their instructions to the central processing unit 20 by means of the keys, switches and control levers.

The display window 24 is, by way of example, implemented by a liquid crystal panel, and the central processing unit 20 produces visual images, which express messages and current status, on the display window 24. Thus, the display window 24 and manipulating panel 23 serve as a man-machine interface.

The communication interface 25 has a modem, which is connected to the communication network 8. When a user requests the server computer 1 to register the automatic player mute piano 2 with the client database 5, the user transmits a data signal, which carries the piece of client information, from the communication interface 25 through the communication network 8 to the server computer 1. A set of music data codes, which a user requests the server computer 1 by means of the portable communication device 3, reaches the communication interface 25, and are stored in the random access memory 22.

The digital signal processor 26 assists the central processing unit 20 in re-enacting a performance on the basis of the set of music data codes. The central processing unit 20 is assumed to decide to process a music data code expressing a note-on message. The music data code is transferred to the digital signal processor 26, and the digital signal processor 26 determines the amount of mean current to be required for the target key motion on the basis of the music data code.

The current driver 27 is responsive to the control data code expressing the amount of mean current, and adjusts the driving signal to a duty ratio equivalent to the amount of mean current. The driving signal is supplied from the current driver 27 to solenoid-operated key actuators 28 and solenoid-operated pedal actuators. As shown in FIG. 1, the solenoid-operated key actuators 28 are respectively provided under the rear portions of the black and white keys 2*d*, and exert force on the rear portions of the black and white keys 2*d* in the presence of the driving signal. Though not shown in the drawings, the pedals 2*k* are respectively associated with the solenoid-operated pedal actuators, and the solenoid-operated pedal actuators depress the pedals 2*k* without any step-on of a human player. Thus, the central processing unit 20 and digital signal processor 26 give rise to the key motion by means of the solenoid-operated key actuators 28 and the pedal motion by means of the solenoid-operated pedal actuators in the playback.

The data storage facility 29 offers a huge memory space to the central processing unit 20, and is implemented by a suitable non-volatile memory driver and information storage medium such as, for example, a hard disk driver and a magnetic disk, a flexible disk driver and flexible disks such as, for example, floppy disks (trademark) or a compact disk driver and compact disks such as, for example, CD-ROMs. The piece of client information, which includes the piece of identification data and address data, is memorized in the read only memory 21 or the data storage facility 29.

An ESSID (Extended Service Set IDentifier) code, a WEP (Wired Equivalent Privacy) key, a communication interface code such as a network card or an identification code assigned to the data storage facility 29 or another system component of the automatic player mute piano 2*a* is usable as the piece of identification data.

Portable Communication Device

In this instance, the portable communication device 3 is implemented by a mobile telephone. The mobile telephone is also labeled with reference sign "3" in the following description. Users usually call one another by means of the mobile telephones 3 through the communication network 8. However, talking circuit components such as, for example, a microphone, an amplifier, a speaker and a volume control circuit are eliminated from FIG. 2 for the sake of simplicity.

The mobile telephone 3 includes a shared bus system 30B, a central processing unit 30, which is abbreviated as "CPU", a read only memory 31, which is abbreviated as "ROM", a random access memory 32, which is abbreviated as "RAM", a manipulating panel 33, a display window 34, a communication interface 35, an antenna 36 and an image pickup device 37 such as, for example, a CCD (Charge Coupled Device) camera. The read only memory 31 contains a semiconductor flash-type electrically erasable and programmable read only memory device. The central processing unit 30, read only memory 31, random access memory 32, manipulating panel 33, display window 34, communication interface 35 and image pickup device 37 are connected to the shared bus system 30B so that address codes, data codes and control codes are transferred through the shared bus system 30B among the system components 30, 31, 32, 33, 34, 35 and 37.

The central processing unit 30 is an origin of the data processing capability, and instruction codes, which form a computer program, are stored in the read only memory 31. The computer program is broken down into a main routine and plural subroutines, and the main routine selectively branches to the subroutines so as to accomplish the given task. A browser runs on the central processing unit 30 as one of the subroutine programs. The random access memory 32 offers a working area to the central processing unit 30.

When a user downloads a music tune to the automatic player mute piano 2, the user transmits the piece of client information and a piece of music data to the server computer 1 through a subroutine assigned to the request for downloading a music tune. The subroutine program for request for downloading will be herein later described in detail.

Button switches, keys and a cursor controller are, by way of example, arranged on the manipulating panel 33. Users manipulate the button switches, keys and cursor for his or her data input works. The central processing unit 30 determines the switches and keys manipulated by the user. The display window 34 is, by ways of example, implemented by a liquid crystal display panel, and visual images are produced on the display window 34 under the control of the central processing unit 30. Thus, the manipulating panel 33 and display window 34 serve as a man-machine interface.

The communication interface 35 includes a radio transmitter and a radio receiver, and the radio transmitter and radio receiver are connected to an antenna 36. Radio waves are captured by means of the antenna 36, and electric current flows from the antenna 36 to the radio receiver for demodulation. A modulated signal is supplied from the radio transmitter to the antenna 36, and radio waves are radiated from the antenna 36. Thus, the mobile telephone 3 is communicable through the communication network 8.

Users take pictures by means of the image pickup device 37. It is possible for a user to use the image pickup device 37 in the request for downloading. As described hereinbefore, a piece of identification data is required for the registration with the client database 5. Various identification codes assigned to the component parts of the automatic player mute piano 2 are available for the identification of the automatic player mute piano 2. Otherwise, a suitable code assigned to the automatic player mute piano 2 on the Internet is also available for the purpose. In case where an ESSID code is stored in the read only memory 21 or data storage facility 29, a user may wish to identify the automatic player mute piano 2 with the ESSID code. The user may think it troublesome to input the ESSID code through the manipulating panel 23.

In this instance, a two-dimensional code such as, for example, a QR (Quick Response) code is used for the automatic player mute piano 2. The name "QR code" is a trademark. At least the identification code, which makes it possible to identify the automatic player mute piano 2, and an address assigned to the server computer 1 are memorized in the QR code. In this instance, a prompt message is further memorized in the QR code. An example of the prompt message is "Here is the automatic playing jukebox! Take the QR code, and you can access the jukebox service." The QR code may be supplied from the server computer 1 during the registration work.

A subroutine program is prepared in the electronic system 2*b* for producing a visual image of the QR code on the display window 24, and another sub-routine program is prepared in the mobile telephone 3 for restoring the image of QR code to the identification code and address assigned to the server computer 1. While the subroutine program is running on the central processing unit 20, the QR code is converted to the pieces of image data expressing the QR code, and the pieces of image data are converted to an image of QR code on the display window 24. The user directs the image pickup device 37 to the image of QR code, and takes the image of QR code through the image pickup device 37. The user restores the image of QR code to the identification code and address through the execution of the subroutine program in the mobile telephone 3, and transmits the identification code to the server computer 1 as the destination of a set of music data codes. Thus, the image pickup device 37 and subroutine programs make the registration work easy and speedy.

Communication Network

The communication network 8 offers a wire transmission network, which is implemented by optical fibers and cables, and radio communication channels to users, and includes radio base stations 8*a*, 8*b*, . . . and exchangers 8*c*, 8*d*, . . . Users connect the server computer 1, automatic player mute piano 2 and mobile telephone to the communication network, and can enter the Internet and LANs (Local Area Network). The radio communication channel is established between the mobile telephone 3 and the radio base station 8*a*, and the piece of identification data and request for downloading are transmitted from the mobile telephone 3 to the radio base station 8*a*. The piece of identification data and request for downloading are relayed through a route in the wire transmission network, and reaches the server computer 1.

Structure of Databases

Turning to FIGS. 3A and 3B, the structure of databases, i.e., the client database 5 and music database 7 is simply illustrated. As described hereinbefore, users register their musical instruments with the client database 5. The users identify the musical instruments with identification codes PianoID01, PianoID02, . . . , respectively, and locate the musical instruments PianoID01, PianoID02, . . . on the Internet with IP (Internet Protocol) addresses [210.145.108.18], [192.168.0.202], . . . As well known to persons skilled in the art, the IP address is expressed by 32-bit code, and is broken down into a global address and a local address. The server computer 1 assigns a file to each client, and writes the identification code PianoID01 or PianoID02, . . . together with the IP address [210.145.108.18] or [192.168.0.2021] . . . in each file. For this reason, the identification codes PianoID01, PianoID02, . . . are respectively accompanied with the IP address [210.145.108.18], [192.168.0.202], . . . in FIG. 3A.

A lot of sets of music data codes are stored in the music database 7. Besides, a table is incorporated in the music database 7, and the registered musical instruments assigned the identification codes PianoID01, PianoID02, PianoID03, PianoID04, . . . . are related to music tunes Song012, Song209, . . . Song503, Song010, Song013, . . . Song055, Song014, . . . performable thereon as shown in FIG. 3B. The music tunes available for the performance on each musical instrument are dependent on the contract between the owner of the musical instrument and the provider who manages the website. The owner may contract with the provider for music tunes in a certain genre. The contract may oblige the provider to supply a certain number of music tunes per a unit time period. The owner may enter into the contract at the registration with the client database 5. The contract clauses are memorized in the client database 5 as "other pieces of information, which are useful for management of music distribution services". If the music tunes are too many to display on the display window 34, the music tunes are categorized, and are arranged in a hierarchy.

In this instance, each of the sets of music data codes expresses MIDI (Musical Instrument Digital Interface) messages such as the note-on events and note-off events and duration between each event and the previous event. The MIDI messages are defined in the MIDI protocols, and the MIDI protocols are well known to the persons skilled in the art. For this reason, no further description is made on the music data codes.

A user is assumed to transmit the identification code assigned to the automatic player mute piano 2 from the mobile telephone 3 to the server computer 1. The central processing unit 10 accesses the music database 7 with the identification code, and reads out the music tunes performable on the automatic player mute piano 2. The server computer 1 transmits the pieces of explanatory codes expressing the music tunes to the mobile telephone 3. The pieces of explanatory data are visualized on the display window 34 so as to assist the user in selecting a music tune to be performed on the automatic player mute piano 2.

Software for Downloading Music Data Codes

Figure 4:
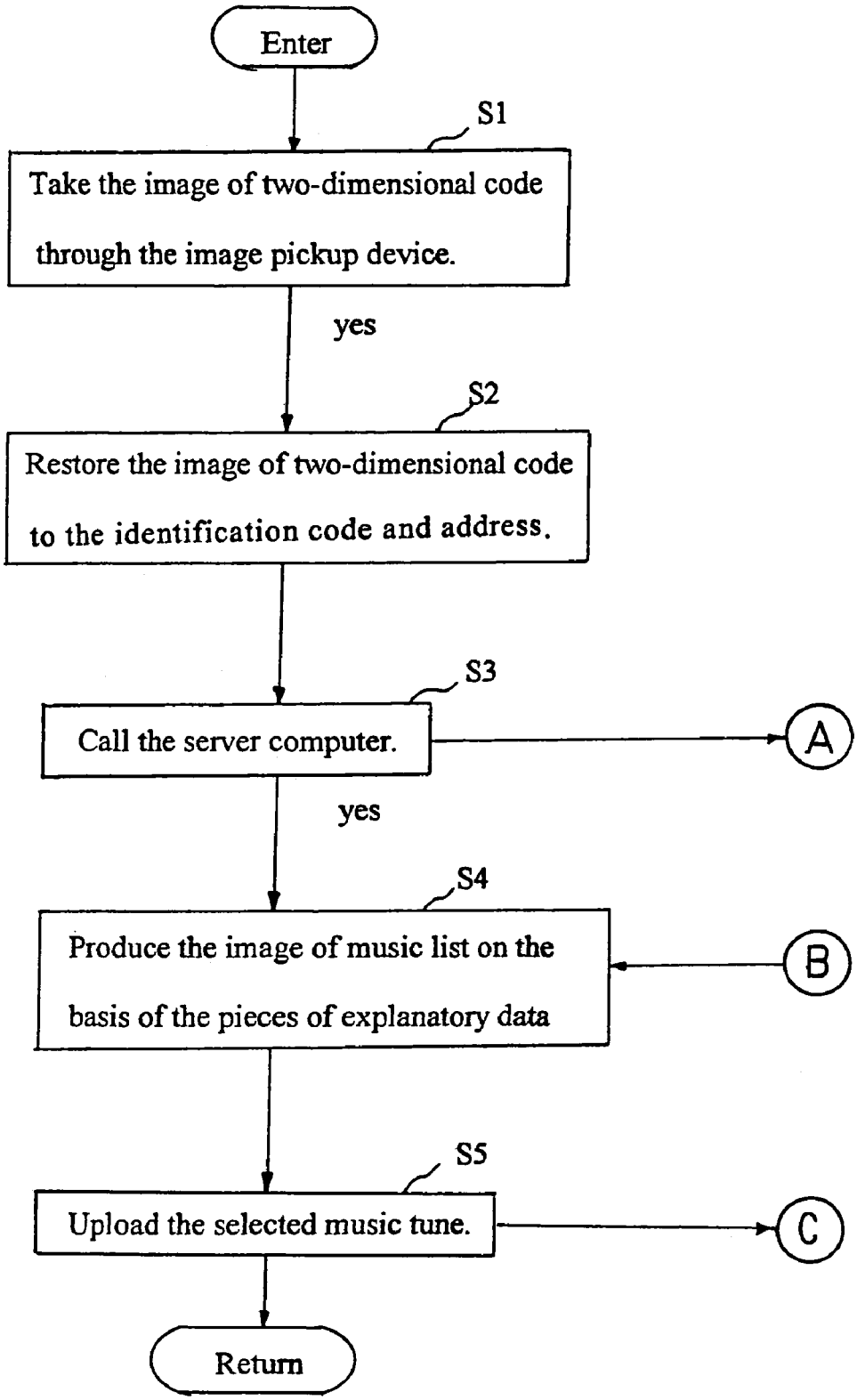
FIG. 4 is a flowchart showing a subroutine program executed in a mobile telephone.
Figure 5:
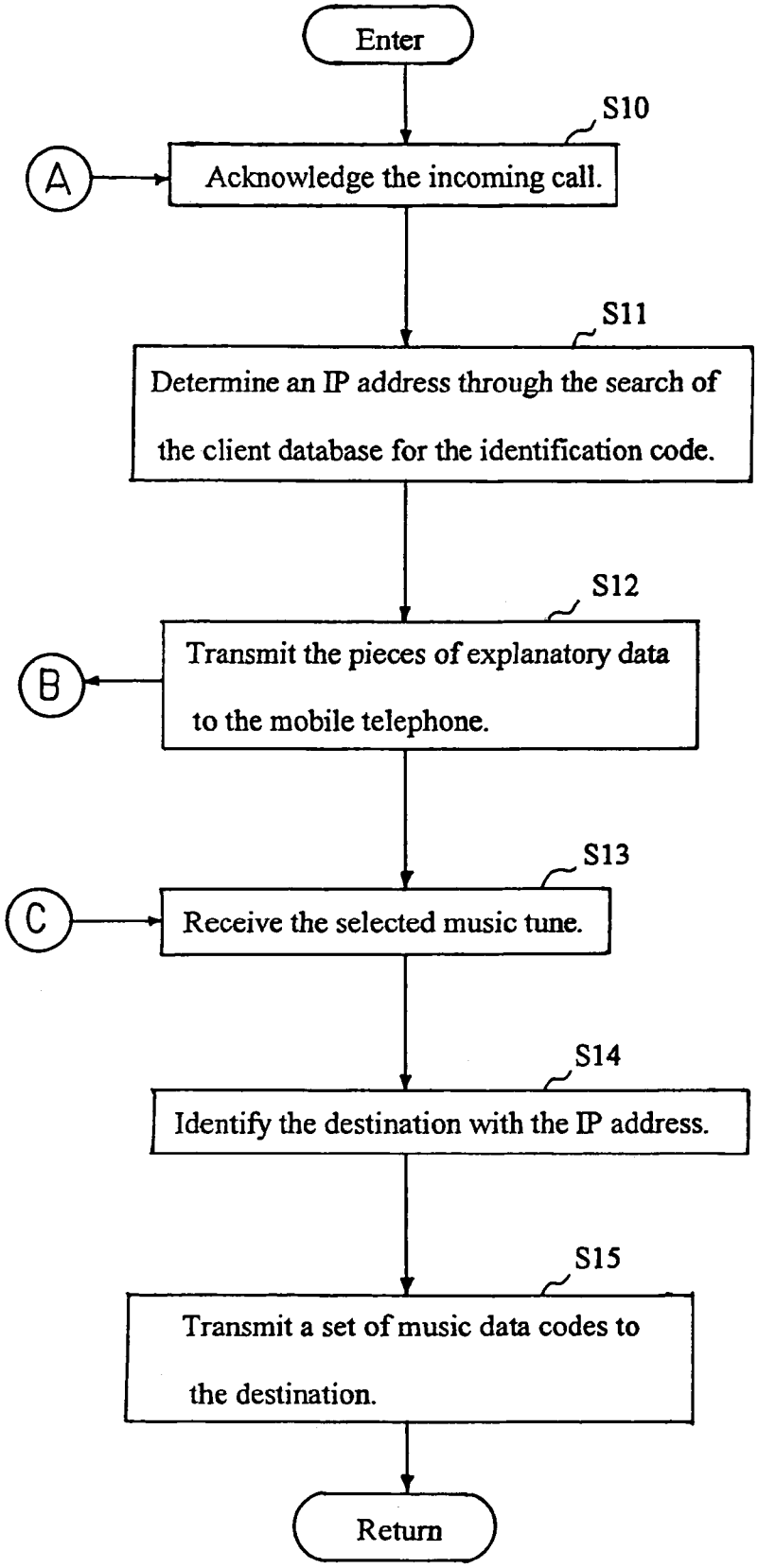
FIG. 5 is a flowchart showing a subroutine program executed in a server computer.

Subsequently, description is made on the subroutine programs for downloading a set of music data codes with reference to FIGS. 4 and 5. Assuming now that a user wishes to make the automatic player mute piano 2, which has been already registered with the client database 5, perform a music tune, the user firstly establishes the communication channel between the automatic player mute piano 2 and the server computer 1 in the communication network 8, and makes the server computer 1 check the client database 5 to see whether or not the automatic player mute piano 2 has been already registered. Subsequently, the user communicates with the server computer 1 through the portable telephone 3, and requests the server computer 1 to transmit a set of music data codes expressing the music tune to the automatic player mute piano 2. The following subroutine programs run on the central processing units 30 and 10, respectively.

Figure 6:
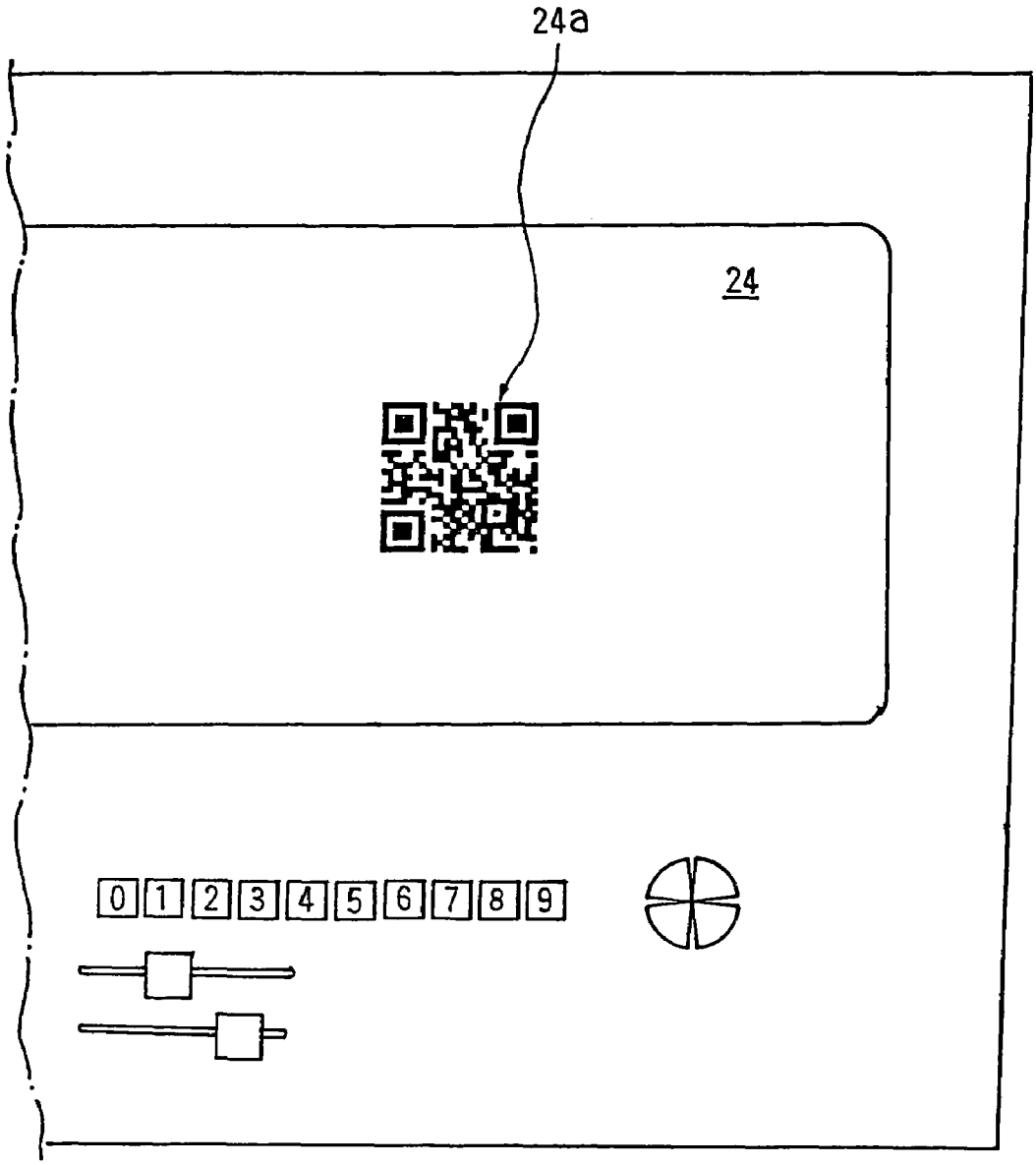
FIG. 6 is a view showing the image of a two-dimensional code.

The user manipulates the manipulating panel 23 to instruct the central processing unit 20 to produce the image of QR code 24*a* on the display window 24 as shown in FIG. 6. Then, the main routine program braches to the subroutine program for producing the visual image of QR code. The central processing unit 20 reads out the QR code from the data storage facility 29, and produces the visual image of QR code on the display window 24 through the execution of subroutine program.

The user directs the image pickup device 37 to the display window 24, and takes the image of QR code by means of the image pickup device 37 as by step S1. The pieces of image data expressing the QR code are temporarily stored in the random access memory 32, and the central processing unit 30 reads out the pieces of image data from the random access memory 32. The central processing unit 30 restores the pieces of image data to the QR code, and determines the identification code and address assigned to the server computer 1 on the Internet as by step S2. Thus, the user prepares the identification code of the automatic player mute piano 2 in the mobile telephone 3. The identification code and address may be stored in the semiconductor flash-type electrically erasable and programmable read only memory device, which forms a part of the read only memory 31, for the latter access.

Subsequently, the user calls the server computer 1 as by step S3. The server computer 1 acknowledges the incoming call as by step S10, and a communication channel is established between the mobile telephone 3 and the server computer 1 in the communication network 8. The identification code is transmitted from the mobile telephone 3 to the server computer 1 through the communication channel.

The music distributor 4 accesses the client database 5, and searches the client database 5 to see whether or not the automatic player mute piano 2 has been registered with the client database 5. If the answer is given negative, the music data distributor 4 transmits a negative message to the mobile telephone 3, and finishes the service. On the other hand, when the music distributor 4 finds the identification code in the client database 5, the music data distributor 4 reads out the IP address and other pieces of information necessary for the music distribution service as by step S11. The music data distributor 4 checks the pieces of information to see whether or not the provider is under the obligation to the user. If the answer is negative, the music data distributor 4 transmits a negative message to the mobile telephone 3, and finishes the service.

When the music data distributor 4 confirms that the user has the right to request the music data distribution service, the music data distributor 4 accesses the music database 7, and reads out the pieces of explanatory data expressing the music tunes available in the music distribution service. Then, the music data distributor 4 transmits the pieces of explanatory data to the mobile telephone 3 as by step S12.

When the pieces of explanatory data reaches the mobile telephone 3, the pieces of explanatory data are temporarily stored in the random access memory 32, and the central processing unit 30 produces a list of music tunes on the display window 34 as by step S4. A massage, which tells the user how to select a music tune, may be added to the list of music tunes. The user scrolls up and down the list on the display window 34, and searches the lift of music tunes for a title of a music tune which he or she wishes. When the user finds the title of music tune, he or she adjusts the curser at the title, and cricks the button switch. Then, the central processing unit 30 acknowledges the title of music tune selected by the user, and prepares pieces of transmission data expressing the title of music tune, account number to which the accounting manager 6 charges the cost for the music distribution service and identification code of the automatic player mute piano 2. The central processing unit 30 delivers the pieces of transmission data to the communication interface 35 so as to upload the tile of music tune as by step S5.

The pieces of transmission data are propagated through the communication channel to the music data distributor 4, and reach the communication interface 15. The central processing unit 10 fetches the pieces of transmission data from the communication interface 15 as by step S13. Thus, the music data distributor 4 acquires the piece of information expressing the identification code and title of music tune to be downloaded to the automatic player mute piano 2.

Subsequently, the music data distributor 4 accesses the client database 5 with the identification code, and reads out the IP address assigned the automatic player mute piano 2 from the client database 5. Thus, the music data distributor 4 identifies the destination of the set of music data codes with the IP address as by step S14.

The music data distributor 4 further accesses the music database 7 with the piece of transmission data expressing the title of music tune, and reads out a set of music data codes expressing the music tune from the music database 7. The music data distributor 4 prepares transmission data including the set of music data codes for the automatic player mute piano 1, and transmits the transmission data to the automatic player mute piano 2 through the communication network 8 as by step S15.

The music data distributor 4 transfers the piece of transmission data expressing the user's account and pieces of service data expressing the contents of music distribution service to the accounting manager 6, and requests the accounting manager 6 to put the bill in the customer's ledger.

The automatic player mute piano 1 receives the transmission data at the communication interface 25, and the set of music data codes is temporarily stored in the random access memory 22.

Another subroutine program for the automatic playing starts to run on the central processing unit 20, and the driving signal is selectively supplied to the solenoid-operated key actuators 28 and solenoid-operated pedal actuators 28. The solenoid-operated key actuators 28 selectively depress and release the black and white keys 2*d*, and the solenoid-operated pedal actuators 28 give rise to the pedal motion. As a result, the acoustic piano tones are generated along the music tune without any fingering of a human player.

As will be understood from the foregoing description, the set of music data codes is directly downloaded to the musical instrument 2, and the portable communication device 3 is used in the user's communication to the server computer 1. In other words, the potable communication device 3 does not participate in the transmission of the set of music data codes. For this reason, it is possible to share the portable communication device 3 among plural musical instruments 2. Thus, the music performance system according to the present invention is simplified by virtue of the separation of the portable communication device 3 from the data transmission route.

Another advantage of the music performance system according to the present invention is the information transmission between the musical instrument 2 and the portable communication device 3 through the image of two-dimensional code. The image is directly taken into the image pickup device 37, and the user is not expected correctly to depress the switches and keys on the manipulating panel 33. Thus, the information transmission through the image makes the music data distribution service easy and speedy.

Second Embodiment

Another music, performance system embodying the present invention largely comprises a server computer 1A, musical instruments and at least one portable communication device. Since the musical instruments and at least one portable communication device are same as those of the first embodiment, the musical instruments and portable communication device are hereinafter labeled with the reference numerals "2" and "3". Although the server computer 1A is different from the server computer 1 in the structure of a music database 7A, the music data distributor 4, client database 5 and accounting manager 6 are also incorporated in the server computer 1A. For this reason, other system components of the server computer 1A are labeled with reference signs designating the corresponding system components of the server computer 1 without detailed description.

Figure 7:
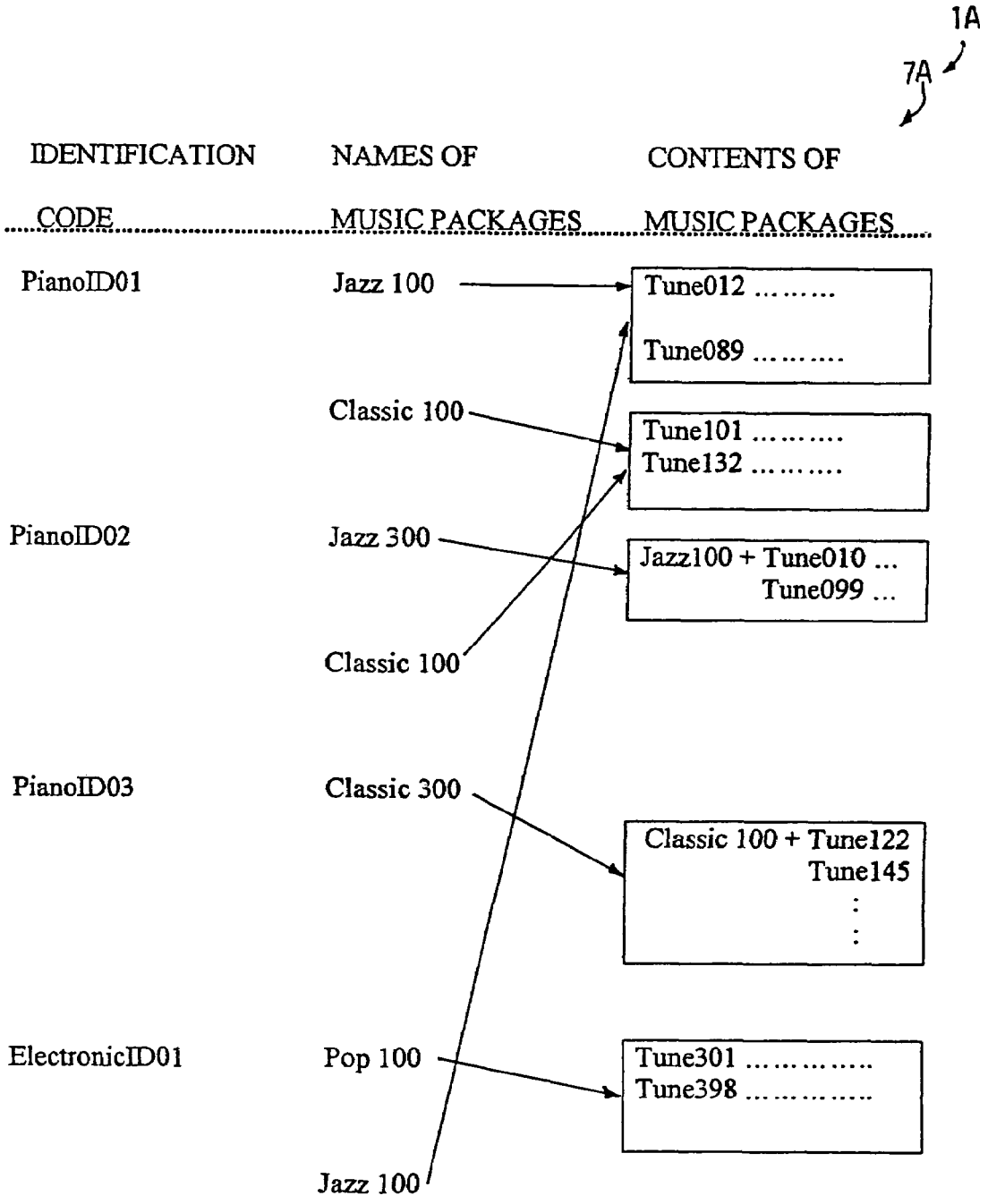
FIG. 7 is a view showing the structure of another music database employed in another music performance system of the present invention.

FIG. 7 shows the structure of the music database 7A. In the music database 7A, music tunes are grouped in music packages Jazz100, Classic100, Jazz300, Classic300, Pop100, . . . The names of music packages expresses the genre of music and the number of music tunes in the package. For example, the package name "Jazz100" expresses that a hundred music tunes are categorized in the jazz music. The package name "Classic300" expresses that three hundred music tunes are categorized in the classic music. Sets of music data codes are labeled with titles such as "Tune012", "Tune089", "Tune101", "Tune 132", "Tune 010", "Tune099", "Tune122", "Tune145", "Tune301", "Tune398", . . . The titles and sets of music data codes form each of the music packages Jazz100, Classic100, Jazz300, Classic300, Pop100, . . . . Thus, the music packages, titles of music tunes and sets of music data codes form a hierarchy in the music database 7A. When only the number of music tunes is different between the music packages such as, for example, between Jazz100 and Jazz300, the large music package contains sets of music data codes different from the small music package, and the same music data codes are shared between the large music package and the small music package.

The identification codes PianoID01, PianoID02, PianoID03, ElectronicID01, . . . are indicative of the musical instruments already registered in the client database 5, and are accompanied with the music packages. The music package or packages for each musical instrument 2 is dependent on the contract between the user and the provider. The owner of musical instrument PianoID01 has contracted with the provider for the music packages "Jazz100" and "Classic100", by way of example.

The hierarchy is helpful to users. A user is assumed to request the server computer 1 to supply a set of music data codes to the musical instrument 2. The user transmits the identification code from the portable communication device 3 to the server computer 1A. When the music data distributor 4 confirms that the provider is under the obligation to offer the music data distribution service to the user, the music data distributor 4 firstly transmits the list of music package names available to the user through the communication network 8 to the portable communication device 3. The list of music package names is visualized on the display window 34 in order to assist the user in selecting the music tune.

The user is assumed to select one of the music packages. The central processing unit 30 prepares pieces of transmission data expressing the destination and the music package selected by the user, and transmits the pieces of transmission data from the portable communication device 3 through the communication network 8 to the music data distributor 4. The music data distributor 4 admits that the user wishes to select a tune from the music package expressed in the piece of transmission data.

The music data distributor 4 reads out the titles of music tunes from the music package, and transmits the list of music tunes to the portable communication device 3. When the transmission data reaches the portable communication device 3, the central processing unit 30 visualizes the list on the display window 34, and assists the user in selecting a music tune. The user specifies a music tune in the list. Then, the central processing unit 30 prepares pieces of transmission data expressing the title of music tune, identification code of the musical instrument and account number, and transmits the pieces of transmission data through the communication network 8 to the music data distributor 4.

The music data distributor 4 admits the title of music tune, and reads out the set of music data codes from the music database 7A. The music data distributor 4 transmits the set of music data codes to the musical instrument 2 assigned the identification code.

The music performance system implementing the second embodiment achieves all the advantages of the first embodiment. Moreover, the hierarchical music database 7A stepwise guides the user to the music tune to be downloaded to the musical instrument 2. Even if a lot of music tunes are available to the user, he or she reaches the target music tune by virtue of the hierarchy.

Third Embodiment

Figure 8:
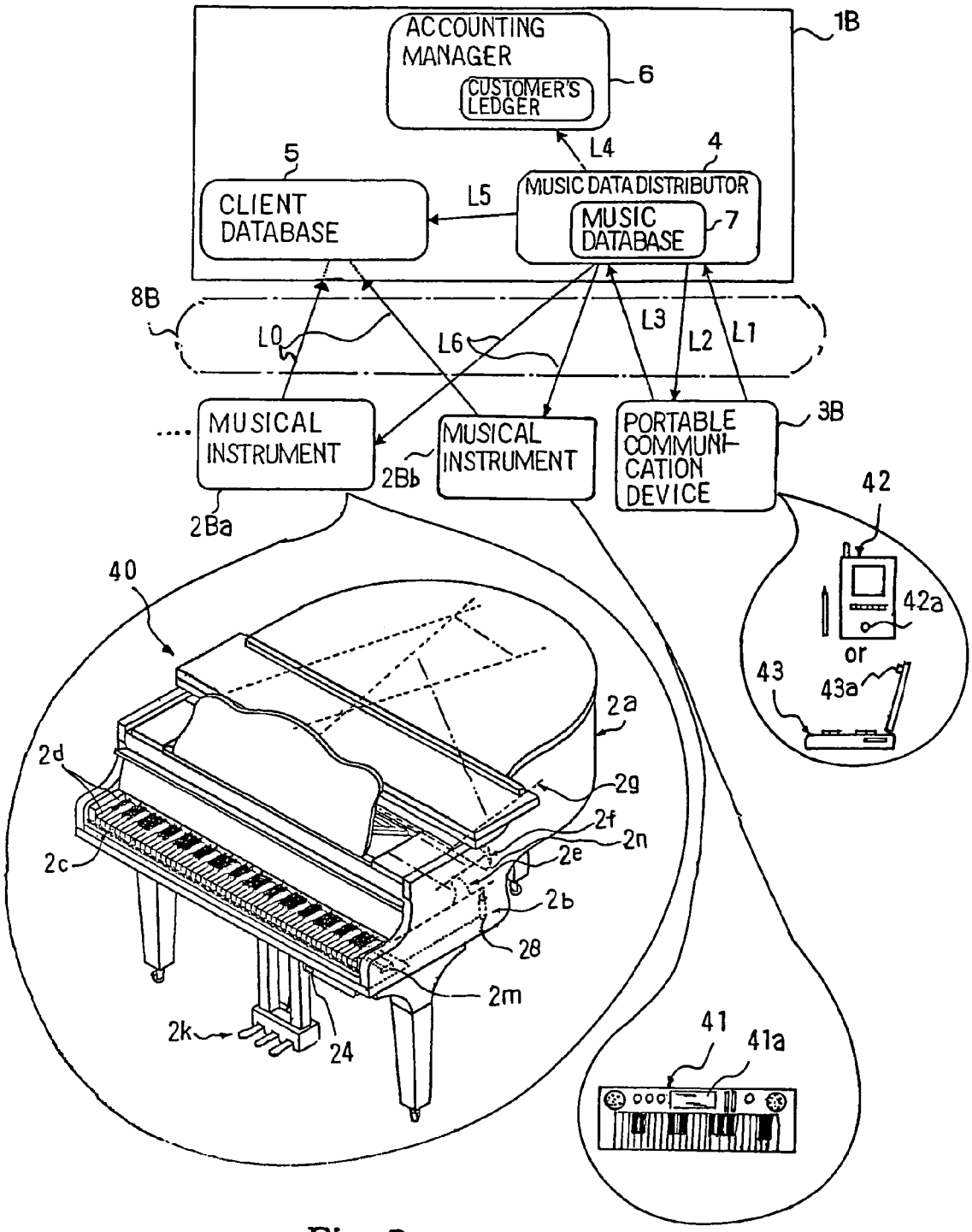
FIG. 8 is a schematic view showing yet another music performance system of the present invention.

Turning to FIG. 8 of the drawings, yet another music performance system embodying the present invention largely comprises a server computer 1B, plural musical instruments 2Ba and 2Bb, a portable communication device 3B and a communication network 8B. Owners have registered the musical instruments 2Ba and 2Bb with a client database 5, which is prepared in the server computer 1B, through the communication networks 8B, and a user requests the server computer 1B to supply sets of music data codes, which are stored in a music database 7, to the musical instruments 2Ba and 2Bb by means of the portable communication device 3B. The registration L0, request L1, L2 and L3 to the server computer 1B and downloading L5 and L6 are similar to those of the first embodiment. For this reason, no further description is hereinafter incorporated for the sake of simplicity.

The server computer 1B and communication network 8B are similar in structure to the server computer 1 and communication network 8 so that components thereof are labeled with references designating the corresponding components of those shown in FIGS. 1 and 2.

The musical instrument 2Ba is implemented by an automatic player mute piano 40 as similar to the musical instrument 2, and components parts of the automatic player mute piano 40 are labeled with reference signs designating the corresponding component parts of the automatic player mute piano 2B without detailed description.

The musical instrument 2Bb is implemented by an electronic keyboard 41. The structure and circuit configuration of the electronic keyboard 41 is well known to persons skilled in the art. For this reason, the description on the structure and circuit configuration is not detailed. The electronic keyboard 41 has a waveform memory, and is responsive to the music data codes for reading out pieces of waveform data from the waveform memory. The pieces of waveform data are formed into an audio signal, and a proper envelope is given to the audio signal. Thus, the electronic keyboard 41 generates electronic tones on the basis of the music data codes.

The portable communication device 3B is implemented by a PDA (Personal Digital Assistants) 42 or a note-size personal computer 43. The PDA 42 and note-size personal computer 43 are equipped with CCD cameras 42*a* and 43*a*, and are communicable with radio base stations on the communication network 8B.

Two-dimensional codes, which are different from one another, are stored in the automatic player mute piano 40 and electronic keyboard 41, respectively. At least the identification code assigned to the musical instruments 2Ba or 2Bb and address assigned to the server computer 1B are incorporated in the two-dimensional code. The images of two-dimensional codes are produced on display windows 24 and 41*a*, and are taken into the PDA 42 or note-size personal computer 43 by means of the CCD camera 42*a* or 43*a*. The two-dimensional codes are stored in the PDA 42 or note-size personal computer 43.

When the user requests the server computer 1B to supply a set of music data codes to the automatic player mute piano 40 or electronic keyboard 41, a user reads out one of the two-dimensional codes from the memory, and establishes a communication channel between the PDA 42 or personal computer 43 and the server computer 1B in the communication network 8B.

Thus, the PDA 42 or personal computer 43 is shared between the plural musical instruments 2Ba and 2Bb, and all the advantages of the first embodiment are also accomplished by using the music performance system implementing the third embodiment.

Although particular embodiments of the present invention have been shown and described, it will be apparent to those skilled in the art that various changes and modifications may be made without departing from the spirit and scope of the present invention.

The table shown in FIG. 3B may be prepared for the clients separately from the lot of sets of music data codes. For example, the lot of sets of music data codes may be managed by another server computer at an IP address different from that of the server computer 1. When a user uploads the selected music tune to the server computer 1, the server computer 1 transmits the piece of explanatory data expressing the selected music tune and the IP address of the automatic player mute piano 2 to the other server computer, and requests the server computer to transmit the set of music data codes expressing the selected music tune to the automatic player mute piano 2. Similarly, the client database 5 may be managed by using another computer at an address different from the address assigned to the music data distributor 4. In this instance, the computers communicate with one another through the communication network 8. In other words, the account manager 6, music data distributor 4, client database 5 and music database 7 may be connected to one another through the communication network 8.

If a small number of music tunes are available to each client, each of the identification codes is directly accompanied with the sets of music data codes expressing the music tunes in a music database. In other words, the table shown in FIG. 3B does not form any part of the music database.

The MIDI protocols do not set any limit to the technical scope of the present invention. Music tunes may be expressed by using PCM (Pulse Code Modulation) codes, and sets of PCM codes form a part of the music database 7.

The image of QR code may be produced on a monitor display unit, or printed on a sheet of paper. Otherwise, a tag, on which the image of QR code has been already printed, may be adhered to the cabinet of the acoustic piano 2*a*.

The music data codes may be sequentially transmitted from the music data distributor 4 to the automatic player mute piano 2 in the streaming. In this instance, the music tune is reproduced through the automatic player mute piano 2 in a real time fashion.

A mobile telephone may have a locator in the GPS system. In this instance, the user, who stands beside the musical instrument 2, transmits a piece of position data expressing the location of the musical instrument to the server computer 1 together with the identification code. The music data distributor 4 quickly routes the data transmission path on the basis of the piece of position data.

An intranet may serve as the communication network 8. The intranet is assumed to establish in a high-rise building or a huge exhibition hall. A user downloads a set of music data codes from the music database 7/7A to a musical instrument on a certain floor or in a certain booth through the intranet, and makes the musical instrument perform the music tune.

The QR code does not set any limit to the technical scope of the present invention. Any sort of two-dimensional code is available for the identification. A DataMatrix code (trademark), a PDF417 code and a Maxi Code (trademark) may be used for the music performance system.

The QR code may be prepared in the automatic player mute piano through an execution of code generation program.

The piece of client data, which expresses the identification code and IP address, does not set any limit to the technical scope of the present invention. Only an IP address or another address assigned to a musical instrument on the communication network 8/8B may serve as "a piece of client data", because the musical instrument is specified with the address. In this instance, the client database is much simpler than the client database 5/5B.

The piece of explanatory data, which expresses a title of music tune, does not set any limit to the technical scope of the present invention. In case where the music tunes in the list are numbered, any one of the music tunes is identifiable with the number. In case where a user specifies a music tune with a crick, any one of the music tunes is identifiable with a cursor, and the coordinate of the cursor is available for the identification of the music tune.

A user may transmit the request for music data distribution service through a desktop personal computer system. Thus, portability is not any indispensable feature of the communication device.

The owner may register his or her musical instrument with the client database 5 through a letter by post. In this instance, when the letter arrives at the provider, an operator inputs the identification code and address so as to register the musical instrument with the client database 5. In case where the two-dimensional code is used for the request for music data distribution service, the operator encloses a sheet of paper where the two-dimensional code is printed in an envelope, and sends it to the owner by post. Otherwise, the operator transmits the two-dimensional code to the musical instrument 2/2Ba/2Bb through the communication network 8/8B.

The component parts and system components of the first, second and third embodiments are correlated with claim language as follows.

The automatic player mute pianos 2 and 40 and electronic keyboard 41 serve as "plural musical instruments", and each of the client databases 5 and each of the music databases 7/7A are respectively corresponding to a "client database" and a "music database", respectively. Each of the music data distributors 4 serves as a "music data distributor", and the central processing unit 10, associated system components and subroutine program shown in FIG. 5 as a whole constitute the music data distributor. The mobile telephone 3, PDA 42 or note-size personal computer 43 serves as a "terminal device", and the central processing unit 30, associated system components and subroutine program shown in FIG. 4 as a whole constitute the terminal device. The piece of explanatory data is equivalent to a "piece of tag data".

What is claimed is:

1. A music performance system for distributing pieces of music data expressing music tunes to users, comprising:

plural musical instruments identifiable with pieces of client data, respectively, and responsive to pieces of music data for performing music tunes;

a client database storing said pieces of client data for establishing communication channels to said plural musical instruments;

a music database storing said pieces of music data respectively expressing said music tunes;

a music data distributor accessible to said client database and said music database, responsive to a request for music data distribution service so as to search said client database to see whether or not a certain piece of client data is found in said client database, and supplying at least one of said pieces of music data to one of said plural musical instruments assigned said certain piece of client data when said certain piece of client data is found in said client database;

a terminal device physically independent of said plural musical instruments, transmitting said request for music data distribution service, said certain piece of client data and a piece of tag data expressing said at least one of said pieces of music data to said music data distributor; and a communication network to which said plural musical instruments, said music data distributor and said terminal device are connectable so that said at least one of said pieces of music data, said request for music data distribution service, said certain piece of client data and said piece of tag data are propagated through said communication channels in said communication network among said one of said plural musical instruments, said music data distributor and said terminal device.

2. The music performance system as set forth in claim 1, in which said music data distributor prepares a list of music tunes available to said one of said plural musical instruments so as to assist a user in selecting said one of said music tunes on said terminal device.

3. The music performance system as set forth in claim 2, in which said list of music tunes is stored in said music database together with other lists of music tunes for the others of said plural musical instruments registered in said client database.

4. The music performance system as set forth in claim 2, in which said list of music tunes has a hierarchical structure.

5. The music performance system as set forth in claim 4, in which said hierarchical structure includes a primary stratum expressing music packages available to said one of said plural musical instruments and a secondary stratus expressing the music tunes of each of said music packages.

6. The music performance system as set forth in claim 1, in which each of said pieces of client data contains an identification code assigned to one of said plural musical instruments and an address of said one of said plural musical instruments on said communication network.

7. The music performance system as set forth in claim 6, in which said identification code and said address are transmitted from said one of said plural musical instruments so that a user registers said one of said plural musical instruments with said client database through said communication network.

8. The music performance system as set forth in claim 6, in which said identification code and an address code expressing an address of said music data distributor form a two-dimensional code.

9. The music performance system as set forth in claim 8, in which said two-dimensional code is stored in said one of said plural musical instruments, and an image of said two-dimensional code is transferred to said terminal device by means of an image pickup device so that said terminal device restores a piece of image data expressing said image to said two-dimensional code.

10. The music performance system as set forth in claim 1, in which said terminal device is portable by a user.

11. The music performance system as set forth in claim 10, in which said terminal device is used as a mobile telephone having a data processing capability.

12. A music data supplier for distributing pieces of music data to plural musical instruments through a communication network, comprising:

a client database storing pieces of client data respectively assigned to said plural musical instruments and expressing destinations of said pieces of music data;

a music database storing said pieces of music data respectively expressing music tunes; and a music data distributor accessible to said client database and said music database, responsive to a request for music data distribution service accompanied with a certain piece of client data and a piece of tag data expressing one of said music tunes and transmitted from a terminal device physically independent of said plural musical instruments through said communication network so as to check said client database to see whether or not said certain piece of client data is found therein, and supplying one of said pieces of music data expressing said certain music tune through said communication network to said one of said plural musical instruments when said certain piece of client data is found in said client database.

13. The music data supplier as set forth in claim 12, in which said music data distributor prepares a list of music tunes available to said one of said plural musical instruments so as to assist a user in selecting said one of said music tunes on said terminal device.

14. The music data supplier as set forth in claim 13, in which said list of music tunes is stored in said music database together with other lists of music tunes for the others of said plural musical instruments registered in said client database.

15. The music data supplier as set forth in claim 13, in which said list of music tunes has a hierarchical structure.

16. The music data supplier as set forth in claim 15, in which said hierarchical structure includes a primary stratum expressing music packages available to said one of said plural musical instruments and a secondary stratus expressing the music tunes of each of said music packages.

17. The music data supplier as set forth in claim 12, in which each of said pieces of client data contains an identification code assigned to one of said plural musical instruments and an address of said one of said plural musical instruments on said communication network.

18. The music data supplier as set forth in claim 17, in which said identification code and said address are transmitted from said one of said plural musical instruments so that a user registers said one of said plural musical instruments with said client database through said communication network.

19. The music data supplier as set forth in claim 17, in which said identification code and an address code expressing an address of said music data distributor form a two-dimensional code.

20. A computer program running on a music data supplier and expressing a method comprising the steps of:

a) preparing a client database storing pieces of client data respectively assigned to plural musical instruments and expressing destinations of pieces of music data and a music database storing said pieces of music data respectively expressing music tunes;

b) receiving a request for music data distribution service and a certain piece of client data from a terminal device physically independent of said plural musical instruments;

c) checking said client database to see whether or not said certain piece of client data indicative of a certain musical instrument is found as one of said pieces of client data; and d) transmitting one of said pieces of music data expressing a certain music tune requested through said terminal device from said music database to one of said plural musical instruments assigned said certain piece of client data when the answer at step c) is given affirmative.

21. The computer program set forth in claim 20, in which said step d) includes the sub-steps of d-1)transmitting a list of music tunes to said terminal device so as to assist a user in selecting said certain music tune from said list, d-2) receiving a piece of tag data expressing said certain music tune from said terminal device through said communication network, d-3) transmitting said one of said music data to said one of said plural musical instruments through said communication network.

* * * * *